US005553676A

United States Patent [19]

Self et al.

[11] Patent Number: 5,553,676

[45] Date of Patent: Sep. 10, 1996

[54] REVERSIBLE EXPANDER

[76] Inventors: Kelvin P. Self, Rte. 7, Box 27; Dirk A. Wilson, 1824 Wildwood Dr., both of Stillwater, Okla. 74075

[21] Appl. No.: 461,967

[22] Filed: Jun. 5, 1995

Related U.S. Application Data

[63] Continuation of Ser. No. 34,298, Mar. 22, 1993, abandoned.

[51] Int. Cl.[6] ..... E21B 7/28

[52] U.S. Cl. ..... 175/19; 175/325.6; 175/325.7; 175/407

[58] Field of Search ..... 175/19, 325.5, 175/325.6, 325.7, 406, 407; 29/447, 508, 525

[56] References Cited

U.S. PATENT DOCUMENTS

| | | | |
|---|---|---|---|
| 531,334 | 12/1894 | Ross . | |
| 928,574 | 7/1909 | Allan . | |
| 3,322,217 | 5/1967 | Cook | 175/406 X |
| 3,411,837 | 11/1968 | Schellstede | 308/4 |
| 3,544,166 | 12/1970 | Proctor | 299/81 |
| 3,575,245 | 4/1971 | Cordary et al. | 175/268 |
| 3,685,597 | 8/1972 | Kostylev et al. | 175/19 |
| 3,874,463 | 4/1975 | Hicks et al. | 175/53 |
| 3,970,157 | 7/1976 | Schmidt | 175/22 |
| 4,100,979 | 7/1978 | Schmidt | 175/19 |
| 4,135,588 | 1/1979 | Wagner | 175/19 |
| 4,198,081 | 4/1980 | Harrison et al. | 285/381 |
| 4,230,051 | 10/1980 | Mays | 52/514 X |
| 4,354,559 | 10/1982 | Johnson | 175/71 |
| 4,508,181 | 4/1985 | Jenne | 175/19 |
| 4,621,698 | 11/1986 | Pittard et al. | 175/19 X |
| 4,694,913 | 9/1987 | McDonald et al. | 175/61 |
| 4,858,704 | 8/1989 | McDonald et al. | 175/61 |
| 4,865,138 | 9/1989 | Swietlik | 175/325.7 |
| 4,907,658 | 3/1990 | Stangl et al. | 175/19 |
| 4,907,661 | 3/1990 | Lloyd | 166/241.6 X |

FOREIGN PATENT DOCUMENTS

| | | | |
|---|---|---|---|
| 476356 | 11/1975 | U.S.S.R. . | |
| 214413 | 5/1977 | U.S.S.R. . | |
| 9004684 | 5/1990 | WIPO | 175/19 |

*Primary Examiner*—David J. Bagnell
*Attorney, Agent, or Firm*—Richards, Medlock & Andrews

[57] ABSTRACT

Several designs of reversible expanders (10, 50, 100, 150) are disclosed for use on an underground boring tool (14) of the type using an air impact hammer. The reversible expanders allow a borehole of larger diameter than the tool to be formed. The reversible expander (10) is interference fit on the outer surface of the boring tool by either pressing the expander onto the tool or by shrink fit. A reversible expander (50) has a split which allows the expander to be slid over the tool and then clamped in place by bolts. A reverse expander (100) is formed of two members (102, 104) which, when bolted together, form a taper lock engagement with the tool. Finally, a reversible expander (150) can be threaded onto threads on the outer surface of the tool.

17 Claims, 4 Drawing Sheets

REVERSIBLE EXPANDER

This is a continuation of U.S. patent application Ser. No. 08/034,298 filed Mar. 22, 1993 now abandoned.

TECHNICAL FIELD OF THE INVENTION

This invention relates to a reversible expander for use with an underground boring tool, particularly an air operated impact boring tool.

BACKGROUND OF THE INVENTION

An air impact operated boring tool is a widely used device for boring underground. In many cases, such tools are used to bore a horizontal hole under a highway or other structure where conventional trench type construction cannot be performed.

The typical air impact tool has a cone shaped nose and a relatively uniform diameter body extending rearward of the nose. The conical nose penetrates the earth as an air operated impact hammer within the tool strikes an anvil at the front of the tool, driving the tool forward. The uniform diameter body is typically the portion of the tool which contains the air impact hammer. Tools of this type can be manufactured in different diameters to drill different size holes.

However, occasionally, it is desired to bore a larger diameter hole than the tool diameter, or to bore a hole in multiple passes with the diameter of the bore being increased at each pass. To accomplish this, expanders have been developed for mounting on a tool which increase the effective outer diameter of the tool. Such expanders can be a permanent addition to the tool, such as a bubble along the length of the outer diameter of the tool or removable additions to the tool. Prior known designs include an expander which slides on the nose of the tool and rests on the front taper or conical nose of the body. Another known design encloses the entire tool with a threaded connection in the middle.

In use, a tool of given diameter can effectively be enlarged by the use of such an expander to bore a larger diameter hole in one pass. Also, the tool can be used without the expander to drill a bore having a diameter corresponding to the diameter of the tool on the first pass of the tool; the expander can then be mounted on the tool and used to enlarge the bore in a second pass by the tool.

All of the existing expanders have deficiencies in one regard or the other. Some of these deficiencies include manufacturing costs, tool performance, non-reversibility, and reliability. A need therefore exists for improved expanders to address some of these deficiencies.

SUMMARY OF THE INVENTION

In accordance with one aspect of the present invention, an expander is provided for an underground boring tool having an outer diameter. The expander includes a cylindrical member with an inner diameter which provides an interference fit to the outer diameter of the tool.

In accordance with another aspect of the present invention, an expander is provided for an underground boring tool having an outer diameter. The expander includes a cylindrical member having at least one split along its length to define first and second facing surfaces and structure for urging the first and second surfaces toward each other to clamp the cylindrical member to the outer diameter of the of the tool.

In accordance with another aspect of the present invention, an expander is provided for an underground boring tool having an outer diameter. The expander includes a first member and a second member. The first and second members are engaged to clamp the member to the outer diameter of the tool. In one structure, the first and second members combine to form a taper lock to the tool. The taper lock can be provided by mating threads on the members or bolts connecting the members.

In accordance with yet another aspect of the present invention, an expander is provided for an underground boring tool having an outer diameter. The expander includes a member threaded onto the outer diameter of the tool.

BRIEF DESCRIPTION OF THE DRAWINGS

A more complete understanding of the invention and its advantages will be apparent from the following Detailed Description when taken in conjunction with the accompany drawings, in which.

DETAILED DESCRIPTION

Figure 1:
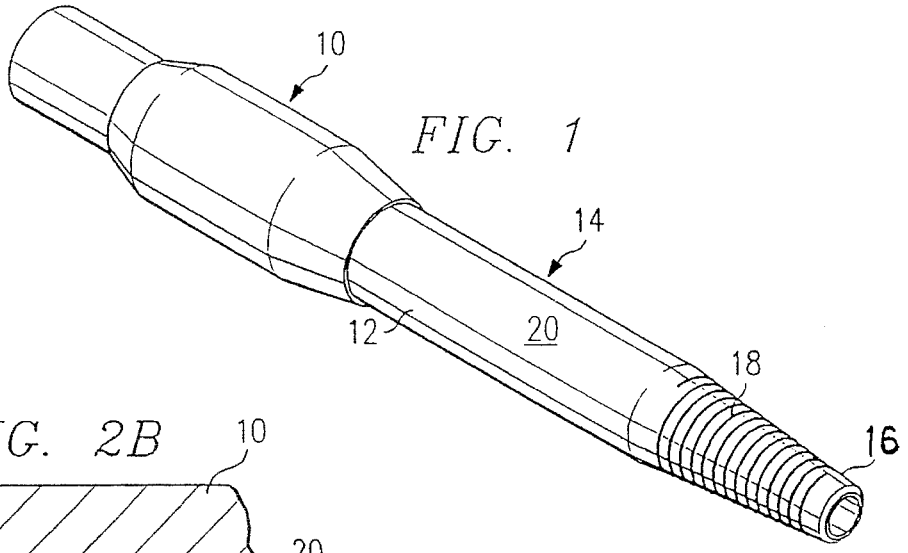
FIG. 1 is a perspective view of a reversible expander forming a first embodiment of the present invention mounted on a boring tool.

Referring now to the drawings, wherein like reference characters designate like or corresponding parts throughout the several views, FIGS. 1–4 illustrate a reversible expander 10 forming a first embodiment of the present invention. The reversible expander 10 is interference fit on the outer surface 12 of a boring tool 14. The boring tool 14 is of the type operated by high pressure air which is driven forward by the impact of a hammer reciprocated within the tool striking an anvil near the nose 16 of the tool. As can be seen, the tool has a tapered end 18 which bores into the ground. The boring tool 14 also has a relatively constant diameter outer surface 20 which extends from the tapered nose to the end of the tool. Without the reversible expander 10, it can be readily seen that the tool 14 would bore a hole underground having a diameter about equal to the diameter of the outer surface 20. By adding the reversible expander 10, the effective radial diameter of the tool is increased, causing the tool to bore a larger diameter hole.

Figure 2B:
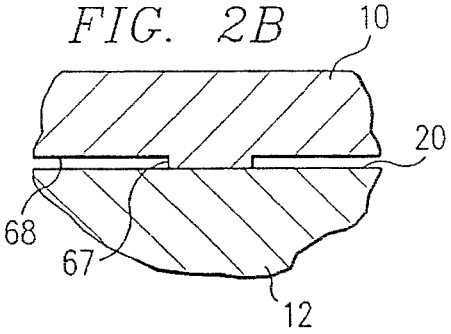
FIG. 2B is a detail of the expander of FIG. 2A illustrating the ring.
Figure 2:
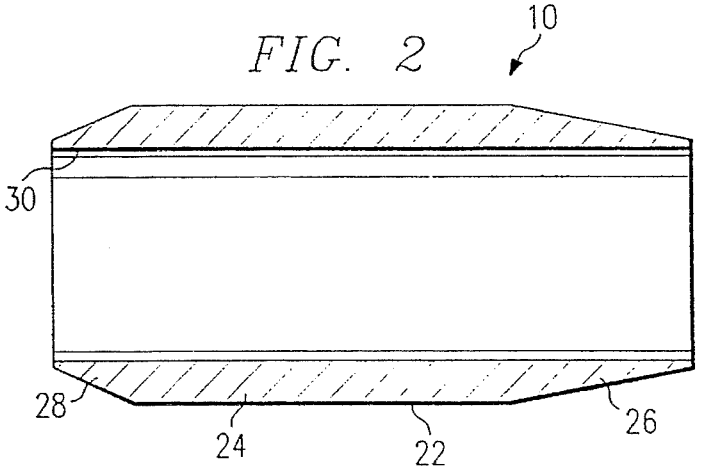
FIG. 2 is a cross-sectional view of the expander.
Figure 3:
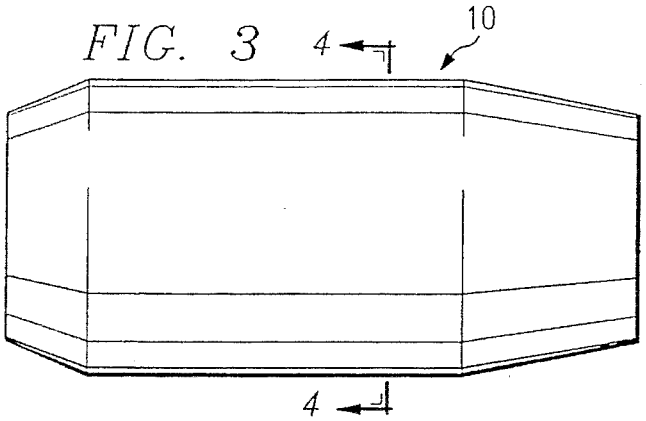
FIG. 3 is a side view of the expander.
Figure 4:
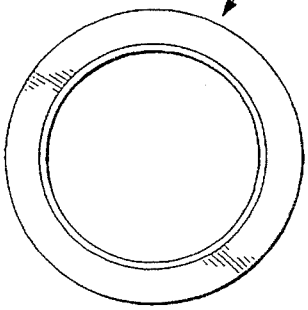
FIG. 4 is a cross-sectional view taken along line 4—4 in FIG. 3.
Figure 5:
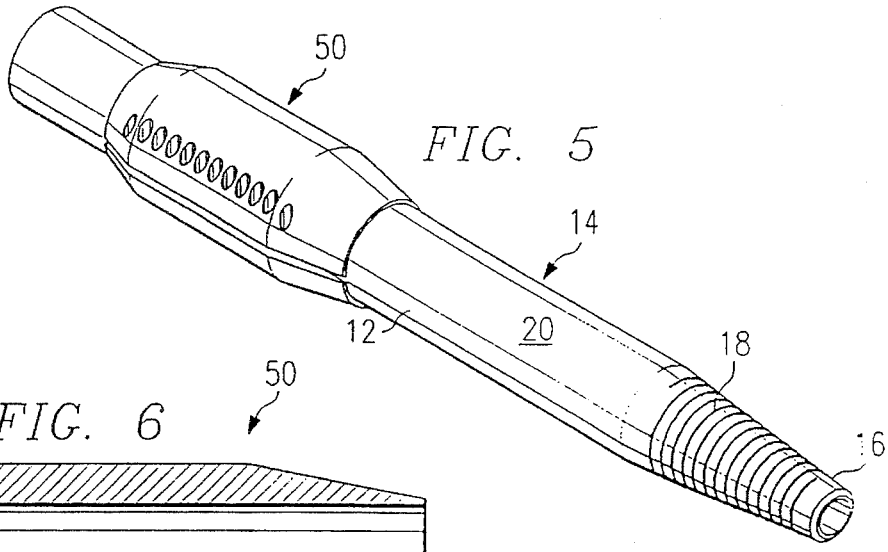
FIG. 5 is a perspective view of a reversible expander forming a second embodiment of the present invention mounted on a boring tool.

As seen in FIGS. 2–4, the expander 10 is formed by a cylindrical member 22 having a relatively uniform diameter middle portion 24, a tapered forward portion 26 and a tapered rearward portion 28.

The expander is secured on the outer surface of the boring tool 14 by an interference fit between the inner surface 30 of the expander and the outer surface of the tool. The expander 10 can be installed on the tool by a hydraulic press. Alternatively, the expander 10 can be shrink fit over the tool by heating the expander 10 to slide over the tool and permitting the expander to shrink into an interference fit as the expander cools. An interference fit is one having limits of size such that the inner diameter 30 of the cylindrical expander is smaller than the outer diameter 20 of the boring tool.

By use of both a tapered forward portion 26 and a tapered rearward portion 28, the tool is reversible. That is, the tool can be operated in either direction.

Figure 7:
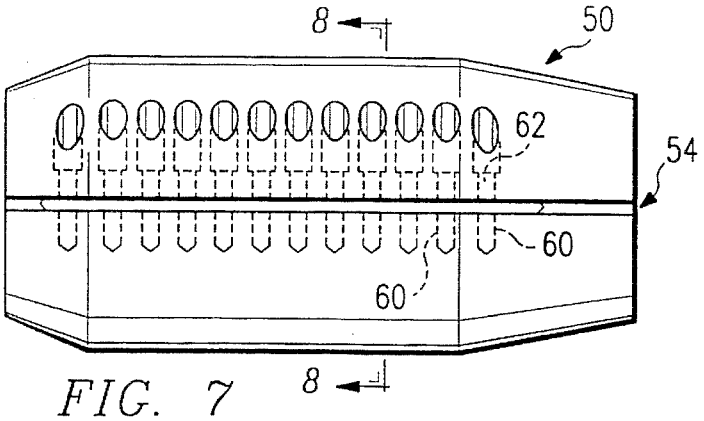
FIG. 7 is a side view of the expander.
Figure 8:
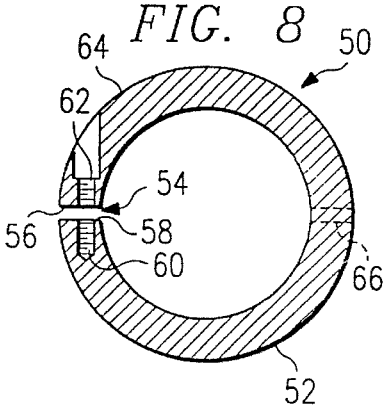
FIG. 8 is a cross-sectional view taken along line 8—8 in FIG. 7.

With reference now to FIGS. 5–8, a reversible expander 50 forming a second embodiment of the present invention is illustrated. The reversible expander 50 is secured to the outer surface 20 of the tool 14 by clamping the expander to the tool. As can be seen in FIGS. 7 and 8, the expander 50 is formed of a cylindrical member 52 having a split 54 along its length defining facing edges 56 and 58.

A series of threaded apertures 60 are formed into face 58 while a series of passages 62 are formed through the facing edge 56 and opening through the exterior surface 64 of the expander to receive bolts to clamp the expander 50 onto the tool. The expander is clamped onto the tool by simply tightening the bolts in a uniform manner to draw the edges 56 and 58 together, decreasing the effective inner diameter of the expander and clamping an expander on the tool.

In another modification, the expander 50 could be split along split 66 as well, as shown in dotted line in FIG. 8, to form two separate semi-cylindrical halves which are clamped together by bolts or other fasteners. Clearly, other mechanisms can be used to clamp the expander on the tool such as an external clamp, etc.

In addition to the clamping action of expander 50, the expander could further be held in place on the tool by either a small step (oversized area) or a notch (undersized area) at the outer surface 12 with a corresponding mating part on the expander 50 which the expander can utilize to hold the expander in place. On the design, a snap ring can be mounted on the tool or between the tool and a tail piece attached to the tool to hold the expander in place. Additionally, it could employ an adhesive bond between the expander and the tool as well.

Figure 2A:
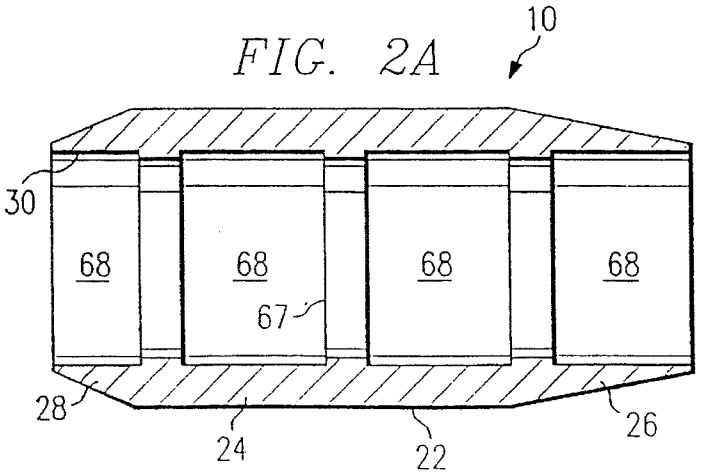
FIG. 2A shows a modification of the expander of FIG. 2.
Figure 6:
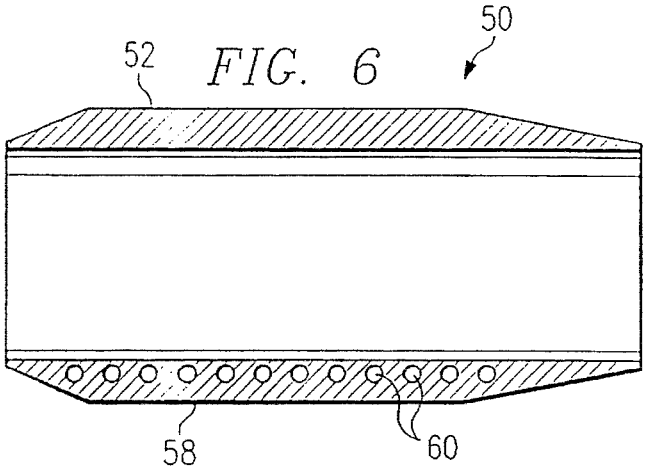
FIG. 6 is a cross-sectional view of the expander.
Figure 6A:
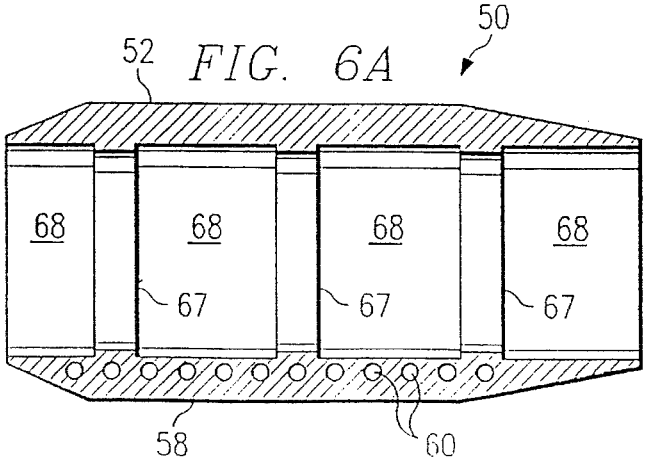
FIG. 6A shows a modification of the expander of FIG. 6.

In another aspect of the present invention, either expander 10 or expander 50 can be provided with a modified structure for enhanced engagement with the outer surface of the tool. The modified expander cylindrical member 10 or 50 has an inner surface which could possess the property of being roughened, or could be composed of alternating rings 67 and grooves 68 (see FIGS. 2A and 6A). These roughened or grooved areas reduce the contact area between the inner surface of the expander and the outer surface of the tool. The increased interference pressure over this reduced contact area helps the expander to better grip the tool. FIG. 2B exaggerates the height of ring 67 for clarity. It would be expected that ring 67 need only have a diameter 0.020 inches less than the diameter of the grooved area to be effective to concentrate the interference forces between the expander and tool 14. For example, three rings ½" wide and 0.020 inches smaller in diameter than the remainder of the inner surface 30, as seen in FIGS. 2A and 6A, would be effective. This feature is particularly effective when the expander is mounted on conventional tools 14 which have a smooth outer surface 12 to avoid any slight movement of the expander on the tool during use.

Figure 9:
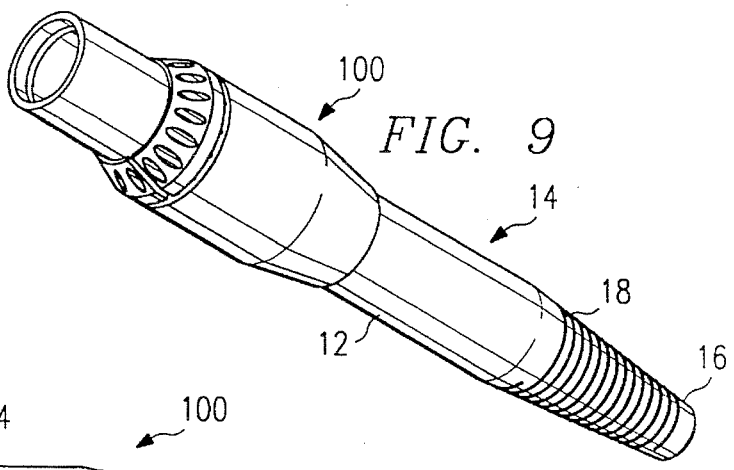
FIG. 9 is a perspective view of a reversible expander forming a third embodiment of the present invention on a boring tool.
Figure 10:
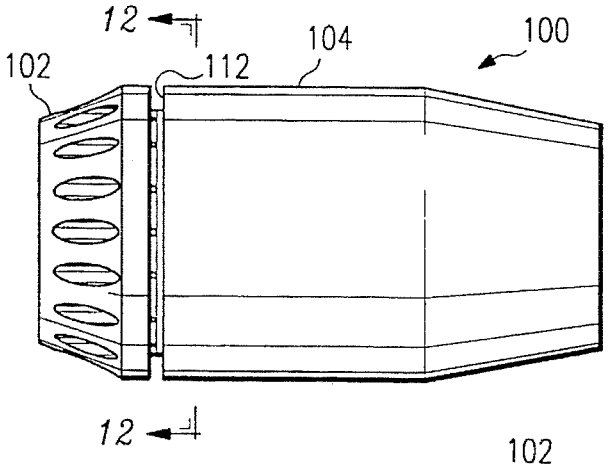
FIG. 10 is a side view of the expander.
Figure 11:
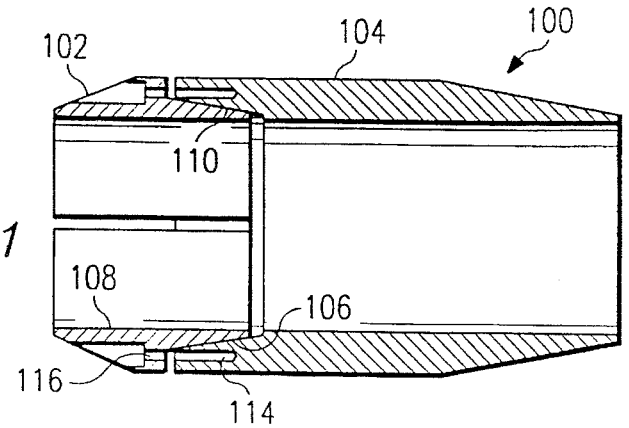
FIG. 11 is a cross-sectional view of the expander.
Figure 12:
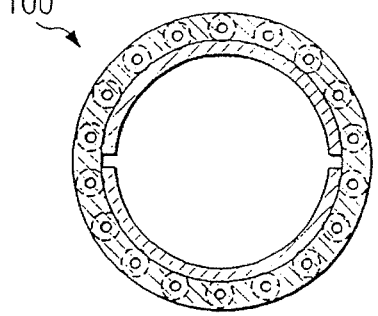
FIG. 12 is a cross-sectional view taken along line 12—12 in FIG. 10.
Figure 13:
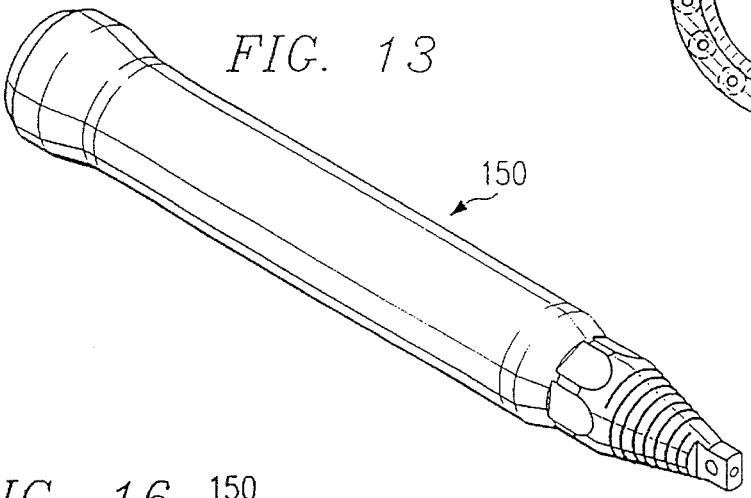
FIG. 13 is a perspective view of a reversible expander forming a fourth embodiment of the present invention mounted on a boring tool.
Figure 16:
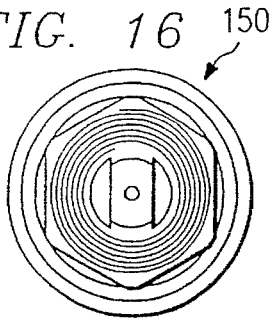
FIG. 16 is an end view of the expander.
Figure 14:
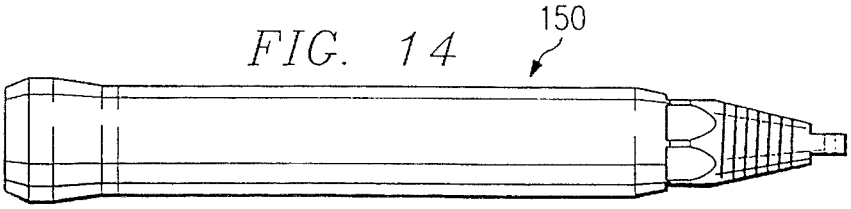
FIG. 14 is a side view of the expander.
Figure 15:
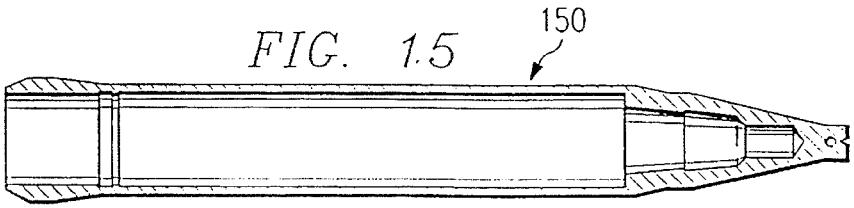
FIG. 15 is a cross-sectional view of the expander.

FIGS. 9–11 disclose a reversible expander 100 forming a third embodiment of the present invention. As can best be seen in FIG. 11, the expander 100 is formed of two cylindrical members 102 and 104. Member 102 has an exterior conical surface 106 formed on a locking portion 108. The member 104 has an interior conical surface 110 which engages the surface 106 as seen in FIG. 11. When the expander members are separated, each can be easily slid over the outer surface 12 of the tool 14. However, when the member 102 and 104 are urged together by threads or bolts, the conical surface 110 rides up over the conical surface 106 and deflects the locking portion 108 into engagement with the outer surface 12 of the tool 14 to secure the expander 100 on the tool.

As illustrated, the end 112 of member 104 has a series of threaded apertures 114 which align with openings 116 formed in cylindrical member 102 to receive a series of bolts to clamp the member 102 and 104 together to lock the expander on the tool. The cylindrical member 102 and 104 could also be drawn together in a locking configuration by forming mating threads on the two members.

With reference now to FIGS. 13–16, a reversible expander 150 forming a fourth embodiment of the present invention is illustrated. The expander 150 is threaded onto the tool 14.

Although several embodiments of the present invention have been illustrated in the accompanying drawings and described in the foregoing detailed description, it will be understood that the invention is not limited to the embodiments disclosed, but is capable of numerous rearrangements, modifications and substitutions of parts and elements without departing from the scope and spirit of the invention.

We claim:

1. An expander for an underground boring tool having an outer diameter, comprising:

a member interference fit to the outer diameter of the tool, the member defining an inner surface to engage the outer diameter of the tool in the interference fit, the inner surface defined by a series of rings and grooves, the rings in interference fit with the tool to concentrate the interference fit forces.

2. The expander of claim 1 wherein the member has a larger outer diameter than the outer diameter of the boring tool.

3. The expander of claim 1 wherein the member is press interference fit over the tool.

4. The expander of claim 1 wherein the member is heat shrunk onto the tool.

5. The expander of claim 1 wherein the member has at least one split along its length to define first and second facing surfaces; and means for urging the first and second surfaces toward each other to clamp the member to the outer diameter of the tool.

6. The expander of claim 5 wherein the member has a tapered forward end and tapered rearward end for reversible operation.

7. The expander of claim 5 wherein the member has an outer surface, the split in the member extending from the outer surface to the inner surface, a plurality of threaded apertures being formed into the member through the second facing surface, a plurality of passages being formed in the member and opening through the first facing surface, each of the threaded apertures being aligned with one of said passages; and a threaded bolt inserted through each opening and threaded into the aligned threaded aperture.

8. The expander of claim 7 wherein the passages are counter-sunk to prevent any portion of the bolts from extending through the outer surface of the expander.

9. The expander of claim 7 wherein the threaded apertures and passages are distributed along the entire length of the expander.

10. The expander of claim 7 wherein the threaded apertures and passages each have an elongate axis, said axis being perpendicular to the first and second facing surfaces.

11. The expander of claim 5 wherein the member has an additional split to form two separate sections.

12. The expander of claim 1 wherein the member has three rings.

13. The expander of claim 1 wherein the inner surface has a constant diameter portion forming the grooves, the rings being formed by structure extending radially inward from the constant diameter portion.

14. The expander of claim 13 wherein the rings extend radially inward about 0.002 inches from the constant diameter portion.

15. The expander of claim 1 wherein the rings each have a width, the width being about 0.5 inches.

16. An expander for an underground boring tool having an outer diameter, comprising:

a first member;

a second member;

the first and second members engaged together to clamp the members to the outer diameter of the tool;

the first member having a locking portion defining an exterior conical surface and the second member having an interior conical surface, the expander further having means for drawing the first and second members together with the surfaces in engagement to deflect the locking portion into the outer diameter of the tool to lock the expander on the tool.

17. The expander of claim 7 wherein said means includes bolts threaded into the second member.

* * * * *